US011236878B2

(12) United States Patent
Lee

(10) Patent No.: US 11,236,878 B2
(45) Date of Patent: Feb. 1, 2022

(54) VEHICLE HEADLAMP WITH HIGH-BEAM AND LOW-BEAM GENERATORS AND CONVEX REFLECTOR

(71) Applicant: HYUNDAI MOBIS Co., Ltd., Seoul (KR)

(72) Inventor: Hyun Soo Lee, Yongin-si (KR)

(73) Assignee: Hyundai Mobis Co., Ltd., Seoul (KR)

( * ) Notice: Subject to any disclaimer, the term of this patent is extended or adjusted under 35 U.S.C. 154(b) by 0 days.

(21) Appl. No.: 17/134,048

(22) Filed: Dec. 24, 2020

(65) Prior Publication Data

US 2021/0199258 A1 Jul. 1, 2021

(30) Foreign Application Priority Data

Dec. 26, 2019 (KR) ..... 10-2019-0175682

(51) Int. Cl.
*F21S 41/265* (2018.01)
*F21S 41/255* (2018.01)
*F21W 102/13* (2018.01)

(52) U.S. Cl.
CPC ..... *F21S 41/265* (2018.01); *F21S 41/255* (2018.01); *F21W 2102/13* (2018.01)

(58) Field of Classification Search
CPC .... F21W 2102/13; F21S 41/25; F21S 41/255; F21S 41/26; F21S 41/265; F21S 41/27; F21S 41/275
See application file for complete search history.

(56) References Cited

U.S. PATENT DOCUMENTS

| | | | | |
|---|---|---|---|---|
| 9,103,518 | B2 | 8/2015 | Owada | |
| 10,309,606 | B2 * | 6/2019 | Takada | F21S 41/338 |
| 10,641,451 | B2 * | 5/2020 | Kawai | F21S 41/37 |

FOREIGN PATENT DOCUMENTS

JP 6016057 10/2016

* cited by examiner

*Primary Examiner* — Robert J May
(74) *Attorney, Agent, or Firm* — H.C. Park & Associates, PLC

(57) ABSTRACT

A lamp for a vehicle includes: a lens being convex outwardly, the lens configured to transmit light; a reflector disposed inward from the lens, being convex upwardly, and configured to reflect light; a low-beam generator disposed below the reflector, the low-beam generator configured to emit a low beam; and a high-beam generator disposed below the low-beam generator, the high-beam generator configured to emit a high beam, wherein a portion of the low beam emitted from the low-beam generator is reflected by an area of the reflector close to the low-beam generator, and reaches a central area of the lens.

12 Claims, 5 Drawing Sheets

VEHICLE HEADLAMP WITH HIGH-BEAM AND LOW-BEAM GENERATORS AND CONVEX REFLECTOR

CROSS-REFERENCE TO RELATED APPLICATION

This application claims priority from and the benefit of Korean Patent Application No. 10-2019-0175682, filed on Dec. 26, 2019, which is hereby incorporated by reference for all purposes as if set forth herein.

BACKGROUND

Field

Exemplary embodiments relate to a lamp for a vehicle and a vehicle having the lamp.

Lamps for vehicles are divided into headlamps mounted on the front of the vehicle and tail lamps mounted on the rear of the vehicle. The headlamps may be mounted on left and right sides of the front of the vehicle, and illuminate the road ahead of the vehicle during night driving and the like to thereby ensure the driver's forward visibility.

Discussion of the Background

Such headlamps may provide separate low and high beams as follows: a high beam used when the vehicle is driving on the road without oncoming vehicles; and a low beam used in normal road conditions except for specific conditions in which the driver is allowed or required to use the high beam.

According to the related art, the high beam and the low beam may be formed of separate modules, and the headlamp may be manufactured by combining the high beam and the low beam which are formed of the separate modules. However, such a manufacturing method may not be efficient in terms of manufacturing cost and time since the high beam and the low beam are manufactured separately. In addition, the overall size of the headlamp may be increased.

The above information disclosed in this Background section is only for enhancement of understanding of the background of the invention and, therefore, it may contain information that does not constitute prior art.

SUMMARY

Exemplary embodiments have been made to solve the above-mentioned problems occurring in the prior art while advantages achieved by the prior art are maintained intact.

An aspect of the invention provides a lamp for a vehicle and a vehicle including the same, capable of providing a high beam and a low beam in a single module, thereby saving the manufacturing cost and time of a headlamp and reducing the size of the headlamp.

According to an aspect of the invention, a lamp for a vehicle includes: a lens being convex outwardly, the lens configured to transmit light; a reflector disposed inward from the lens, being convex upwardly, and configured to reflect light; a low-beam generator disposed below the reflector, the low-beam generator configured to emit a low beam; and a high-beam generator disposed below the low-beam generator, the high-beam generator configured to emit a high beam, wherein a portion of the low beam emitted from the low-beam generator is reflected by an area of the reflector close to the low-beam generator, and reaches a central area of the lens.

A portion of the low beam emitted from the low-beam generator may be reflected by a peripheral area of the reflector being closest to the low-beam generator, and may reach the central area of the lens.

The lens may include: an upper lens forming an upper area of the lens; a lower lens forming a lower area of the lens; and a connection area disposed between the upper lens and the lower lens, a portion of the low beam emitted from the low-beam generator is reflected by the area of the reflector close to the low-beam generator, and reaches the connection area of the lens, and the connection area is disposed in the central area.

A portion of the high beam emitted from the high-beam generator may reach the connection area of the lens, and the low beam and the high beam may overlap in the connection area.

A radius of curvature of the upper lens may be different from that of the lower lens.

The lamp may further include a shield disposed below the low-beam generator and above the high-beam generator, the shield configured to block at least a portion of the low beam emitted from the low-beam generator.

The high-beam generator may include: a high-beam light source configured to generate a high beam; a rod for providing a path through which the high beam generated by the high-beam light source travels; and a high-beam emitter by which the high beam traveling through the rod is emitted to the lens.

The high-beam light source may include a plurality of high-beam light sources, the rod may include a plurality of rods, and the plurality of high-beam light sources and the plurality of rods may correspond to each other in one-to-one relationships.

On/off operations of the plurality of high-beam light sources may be controlled independently of each other.

The shield may have a recessed portion in a peripheral area thereof, the recessed portion facing the lens.

The central area of the lens, into which a portion of the low beam emitted from the low-beam generator is transmitted by being reflected by the area of the reflector close to the low-beam generator, may have a vertical width of 5 mm to 7 mm.

According to another aspect of the invention, a vehicle includes a lamp, wherein the lamp includes: a lens being convex outward, the lens configured to transmit light; a reflector disposed inward from the lens, being convex upwardly, and configured to reflect light; a low-beam generator disposed below the reflector, the low-beam generator configured to emit a low beam; and a high-beam generator disposed below the low-beam generator, the high-beam generator configured to emit a high beam, wherein a portion of the low beam emitted from the low-beam generator is reflected by an area of the reflector close to the low-beam generator, and reaches a central area of the lens.

The lamp may be mounted to a front of the vehicle.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
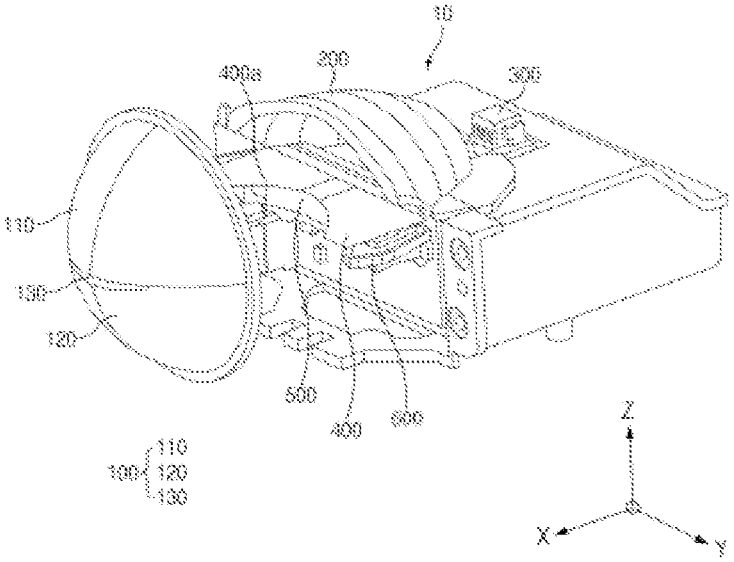
FIG. 1 is a perspective view of an exemplary embodiment of a lamp for a vehicle constructed according to the principles of the invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. Like reference numerals in the drawings denote like elements.

Various advantages and features of the present invention and methods accomplishing thereof will become apparent from the following description of embodiments with reference to the accompanying drawings. However, the present invention is not be limited to the embodiments set forth herein but may be implemented in many different forms. The present embodiments may be provided so that the disclosure of the present invention will be complete, and will fully convey the scope of the invention to those skilled in the art and therefore the present invention will be defined within the scope of claims. Like reference numerals throughout the description denote like elements.

Unless defined otherwise, it is to be understood that all the terms (including technical and scientific terms) used in the specification has the same meaning as those that are understood by those who skilled in the art. Further, the terms defined by the dictionary generally used should not be ideally or excessively formally defined unless clearly defined specifically. It will be understood that for purposes of this disclosure, "at least one of X, Y, and Z" can be construed as X only, Y only, Z only, or any combination of two or more items X, Y, and Z (e.g., XYZ, XYY, YZ, ZZ). Unless particularly described to the contrary, the term "comprise", "configure", "have", or the like, which are described herein, will be understood to imply the inclusion of the stated components, and therefore should be construed as including other components, and not the exclusion of any other elements.

Hereinafter, a lamp for a vehicle and a vehicle including the same according to exemplary embodiments of the present disclosure will be described in detail with reference to the accompanying drawings.

Lamp for Vehicle and Vehicle Including the Same

Figure 2:
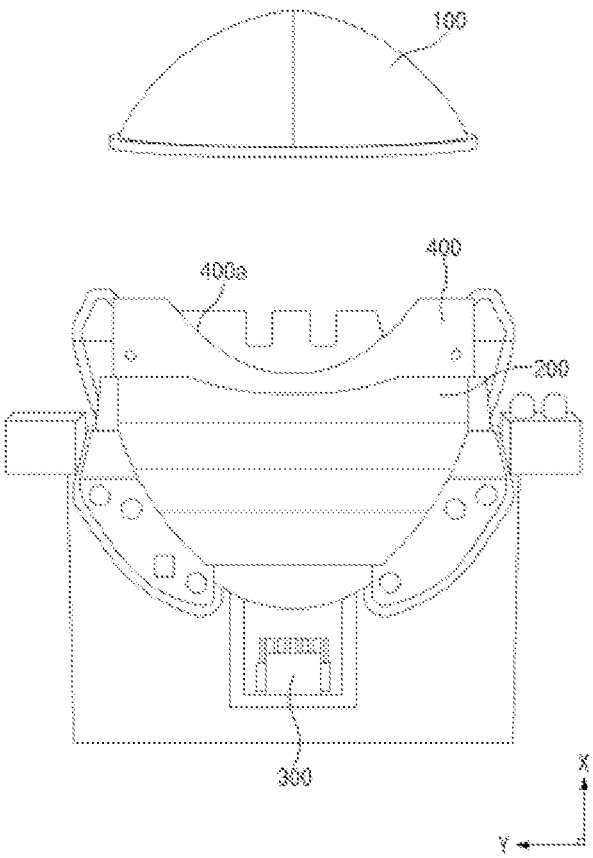
FIG. 2 is a plan view of the lamp for the vehicle of FIG. 1.
Figure 3:
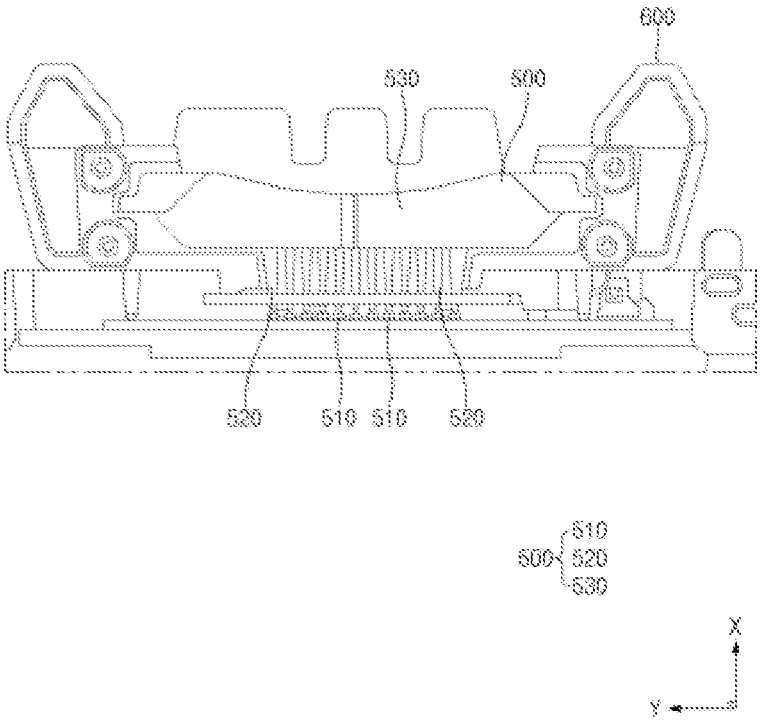
FIG. 3 is a bottom view of a high-beam unit and its peripheral elements in the lamp for the vehicle of FIG. 1.
Figure 4A:
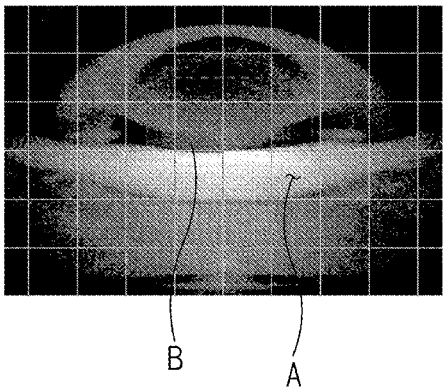
FIGS. 4A and 4B illustrate pictures of areas illuminated by light when the lamp for the vehicle of FIG. 1 is operated.
Figure 4B:
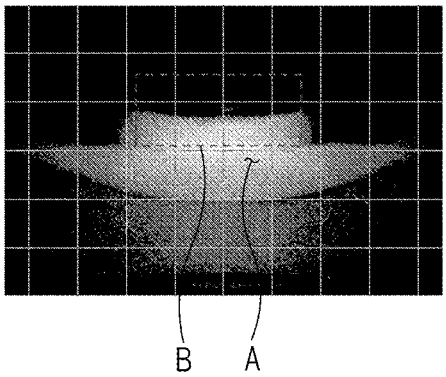
Figure 5:
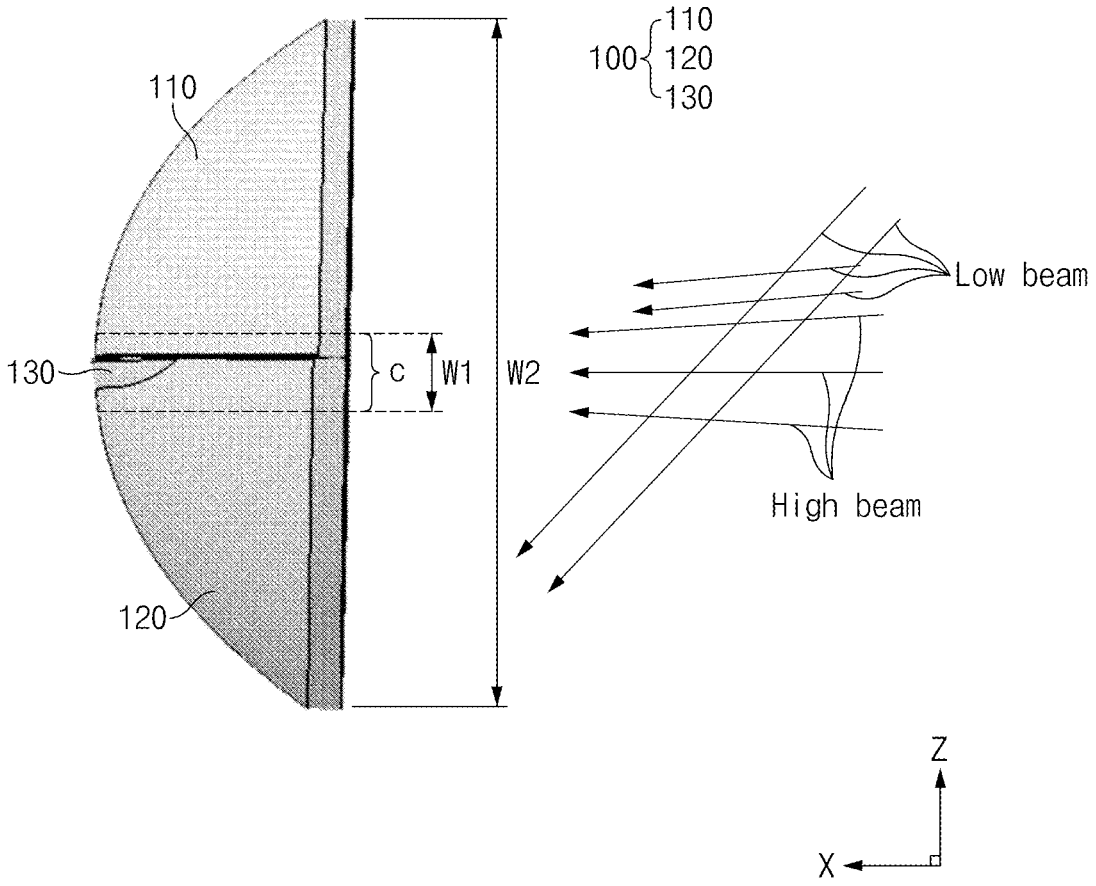
FIG. 5 is a vertical sectional view of light rays reaching a lens unit of the lamp for the vehicle of FIG. 1.

FIG. 1 illustrates a perspective view of a lamp for a vehicle according to an exemplary embodiment, and FIG. 2 illustrates a plan view of a lamp for a vehicle according to an exemplary embodiment. In addition, FIG. 3 illustrates a bottom view of a high-beam unit and its peripheral elements in a lamp for a vehicle according to an exemplary embodiment, and FIGS. 4A and 4B illustrates pictures of areas illuminated by light when a lamp for a vehicle according to an exemplary embodiment is operated. FIG. 5 illustrates a vertical sectional view of light rays reaching a lens unit of a lamp for a vehicle according to an exemplary embodiment. For example, the lamp for a vehicle according to exemplary embodiments may be applied to a headlamp mounted on the front of the vehicle.

As illustrated in FIG. 1, a lamp 10 for a vehicle according to an exemplary embodiment may include a lens unit 100 which is convex outwardly (e.g., in a positive x-axis direction), and through which light transmits. The lens unit 100 may transmit the light reaching the lens unit therethrough. Thus, the lens unit 100 may be made of a material for transmitting light, especially, visible light therethrough.

In addition, the lamp 10 for a vehicle according to an exemplary embodiment include a reflector 200 which is provided inwardly (e.g., in a negative x-axis direction) from the lens unit 100 and is convex upwardly (e.g., in a positive z-axis direction). The reflector 200 may reflect light striking the reflector. Thus, the reflector 200 may be made of a material capable of reflecting light, e.g., visible light.

Referring to FIGS. 1 and 2, the lamp 10 for a vehicle according to an exemplary embodiment may further include a low-beam unit 300 which is provided below the reflector 200 and emits a low beam.

The low-beam unit may illuminate or light the road such that other drivers and pedestrians can see or recognize the vehicle's position from a far distance, and may direct or emit the light downwardly while providing forward illumination to help the driver to see or observe the road ahead.

In addition, the lamp 10 for a vehicle according to an exemplary embodiment further include a high-beam unit 500 which is provided below the low-beam unit 300 (e.g., in a negative z-axis direction) and emits a high beam.

The high-beam unit may have similar roles to those of the low-beam unit. For example, the high-beam unit may illuminate or light the road such that other drivers and pedestrians can see or recognize the vehicle's position from a far distance, and provides forward illumination to help the driver to see or observe the road ahead, but the high-beam unit may be turned on when the aforementioned roles cannot be properly performed by only the low beam. The high-beam unit may direct or emit the light upwardly.

In addition, the lamp 10 for a vehicle according to an exemplary embodiment further include a shield 400 which is provided below the low-beam unit 300 (e.g., in a negative z-axis direction) and above the high-beam unit 500 (e.g., in a positive z-axis direction), and blocks at least a portion of the low beam emitted from the low-beam unit 300 or blocks at least a portion of the high beam emitted from the high-beam unit 500. For example, the shield 400 may allow at least a portion of the low beam emitted from the low-beam unit 300 or at least a portion of the high beam emitted from the high-beam unit 500 to reach the lens unit 100, thereby regulating or controlling an area illuminated or lightened by the high beam or the low beam. More specifically, as illustrated in FIGS. 1 and 2, the shield 400 may have a recessed portion 400*a* in a peripheral area of the shield 400. For example, the recessed portion 400*a* may face the lens unit 100.

FIGS. 4A and 4B illustrate pictures of areas illuminated by light when a lamp for a vehicle according to an exemplary embodiment is operated. More specifically, the picture of FIG. 4A shows an area of the ground which is illuminated by light when the low-beam unit 300 is turned on, and the picture of FIG. 4B shows an area of the ground which is illuminated by light when the low-beam unit 300 and the high-beam unit 500 are turned on.

As described above, since the low-beam unit 300 directs or emits the light forward and downward, the low beam emitted from the low-beam unit 300 may reach a lower area (see areas A of FIGS. 4A and 4B) in front of the vehicle.

However, at least a portion of the low beam emitted from the low-beam unit 300 needs to reach not only the areas A of FIGS. 4A and 4B but also areas B of FIGS. 4A and 4B, which is an upper area above the areas A of FIGS. 4A and 4B. This is required by the regulations for vehicle lamp performance. It is intended to prevent accidents (e.g., traffic accidents) even when only the low beam is emitted, by allowing the driver to see or recognize the presence of an object in an upper area (see the areas B of FIGS. 4A and 4B) in front of the vehicle.

In order to satisfy the requirements of such regulations, the following method may also be considered: an element for reflecting light may be additionally provided between the low-beam unit and the lens unit, thereby causing part of the low beam emitted from the low-beam unit to be reflected and reach the areas B of FIGS. 4A and 4B.

However, since the high-beam unit 500 and the shield 400 is disposed between the low-beam unit 300 and the lens unit 100, the path of light emitted from the high-beam unit 500 may be interrupted when the element for reflecting light is additionally provided between the low-beam unit 300 and the lens unit 100. Thus, such a method may not be desirable.

According to an exemplary embodiment, a portion of the low beam emitted from the low-beam unit 300 may be reflected by the reflector 200, and be then transmitted to reach a central area C (see FIG. 5) of the lens unit 100. Here, the central area C of the lens unit 100 may be defined in a vertical direction (e.g., the z-axis direction) as illustrated in FIG. 5.

That is, according to an exemplary embodiment, as a portion of the low beam emitted from the low-beam unit 300 is reflected by the reflector 200 and is then cast or traveled into a lower area of the lens unit 100, the low beam may reach the areas A of FIGS. 4A and 4B. As the other portion of the low beam emitted from the low-beam unit 300 is reflected by the reflector 200 and is then cast or traveled into the central area C (see FIG. 5) of the lens unit 100, the low beam may finally reach the areas B of FIGS. 4A and 4B. Thus, the original function of the low beam may be exhibited or realized such that the low beam reaches the areas A of FIGS. 4A and 4B, and the additional regulations for the low beam may also be met or satisfied (e.g., the low beam also reaches the areas B of FIGS. 4A and 4B). Here, as shown in the picture of FIG. 4A, when only the low-beam unit 300 is turned on, brightness in the areas A of FIGS. 4A and 4B may be greater than that in the areas B of FIGS. 4A and 4B.

In addition, the central area C of the lens unit 100, into which a portion of the low beam emitted from the low-beam unit 300 is cast or traveled by being reflected by an area of the reflector 200 close to the low-beam unit 300, may have a vertical width W1 of 5 mm to 7 mm. For example, the vertical width W1 of the central area C may be 6 mm (e.g., in the z-axis direction).

For example, the total width W2 of the lens unit 100 in the vertical direction (e.g., the z-axis direction) may be 47 mm to 53 mm. For example, the total vertical width W2 of the lens unit 100 may be about 50 mm.

For example, in order for a portion of the low beam emitted from the low-beam unit 300 and cast or traveled into the central area C of the lens unit 100 to reach an area required by the regulations (the areas B of FIGS. 4A and 4B), the low beam reflected by the reflector 200 needs to travel in a nearly or substantially horizontal direction. This is because even though the low beam reflected by the reflector 200 reaches the central area C of the lens unit 100, it may not reach the area required by the regulations, but may reach the lower area if it travels in a nearly or substantially vertical direction.

Thus, a portion of the low beam emitted from the low-beam unit 300 and cast or traveled into the central area C of the lens unit 100 may be reflected by the area of the reflector 200 close to the low-beam unit 300. More preferably, part of the low beam emitted from the low-beam unit 300 and cast or traveled into the central area C of the lens unit 100 may be reflected by a peripheral area of the reflector 200 which is closest to the low-beam unit 300. In this case, the low beam reflected by the reflector 200 may travel in the nearly horizontal direction (as close to the central area C as possible) so that the low beam may easily reach the area required by the regulations (e.g., the areas B of FIGS. 4A and 4B).

For example, as illustrated in FIGS. 1 and 5, the lens unit 100 according to an exemplary embodiment may include an upper lens 110 forming an upper area of the lens unit 100, a lower lens 120 forming a lower area of the lens unit 100, and a connection area 130 formed between the upper lens 110 and the lower lens 120 and connecting the upper lens 110 and the lower lens 120 to each other. The upper lens 110, the lower lens 120, and the connection area 130 may be integrally formed. Here, the expression that a plurality of elements are integrally formed means that the plurality of elements are integral or essential to the formation of a unitary one-piece structure to the extent that they cannot be separated from each other without at least some of the elements being damaged.

Referring to FIG. 5, the connection area 130 of the lens unit 100 may be disposed in the central area C of the lens unit 100. A portion of the low beam emitted from the low-beam unit 300 may be reflected by the area of the reflector 200 close to the low-beam unit 300 so that the reflected light may reach the connection area 130 of the lens unit 100. For example, a portion of the low beam emitted from the low-beam unit 300 may be reflected by the peripheral area of the reflector 200 which is closest to the low-beam unit 300 so that the reflected light may reach the connection area 130 of the lens unit 100. FIG. 5 illustrates the connection area 130 which is formed in the center of the central area C.

For example, the upper lens 110 and the lower lens 120 of the lens unit 100 may have predetermined radii of curvature, and the radius of curvature of the upper lens 110 may be different from that of the lower lens 120. Thus, the connection area 130 of the lens unit 100 may serve as a buffer for naturally connecting the upper lens 110 and the lower lens 120 having different radii of curvature.

Referring to FIGS. 4 and 5, when the low-beam unit 300 and the high-beam unit 500 are turned on, a portion of the high beam emitted from the high-beam unit 500 may reach the connection area 130 of the lens unit 100. Thus, the low beam and the high beam may overlap in the connection area 130. In the picture of FIG. 4B, the low beam and the high beam overlap in the area B as the low-beam unit and the high-beam unit are all turned on.

As illustrated in FIG. 3, the high-beam unit 500 may include a high-beam light source 510 for generating a high beam, a rod 520 providing a path through which the high beam generated by the high-beam light source 510 travels, and a high-beam emitter 530 by which the high beam traveling through the rod 520 is emitted to the lens unit 100 (see FIG. 1). The high-beam emitter 530 may be made of silicon. The high-beam light source 510 may be a light-emitting diode (LED).

Here, the high-beam light source 510 may include a plurality of light sources, and the rod 520 may include a plurality of rods. In addition, the number of high-beam light sources 510 may be the same as the number of rods 520. FIG. 3 illustrates twelve high-beam light sources 510 and twelve rods 520.

In addition, when the plurality of high-beam light sources 510 and the plurality of rods 520 are provided in the same number as mentioned above, the plurality of high-beam light sources 510 and the plurality of rods 520 may correspond to each other in one-to-one relationships. Thus, the high beam generated by one high-beam light source 510 may pass through one corresponding rod 520 and travel to the high-beam emitter 530.

According to an exemplary embodiment, when the plurality of high-beam light sources 510 are provided, the on/off operations of the plurality of high-beam light sources 510 may be controlled independently of each other. Thus, the area(s) to be illuminated by the high beam may be regulated according to road conditions in front of the vehicle to which the above-described lamp is mounted.

As illustrated in FIGS. 1 and 3, the lamp 10 for a vehicle according to an exemplary embodiment may further include a bracket 600 provided below the high-beam unit 500. The bracket 600 may be attached to a bottom surface of the high-beam unit 500, and support and fix the high-beam unit 500.

A vehicle according to an exemplary embodiment may include the lamp 10 for a vehicle. Since the configuration and features of the lamp 10 are similar to or the same as those described hereinabove and illustrated in the drawings, a detailed description thereof will be omitted for descriptive convenience. In addition, the lamp 10 for a vehicle may be mounted to the front of the vehicle as described above.

As set forth above, the lamp for a vehicle according to exemplary embodiments may provide the high beam and the low beam in a single module, thereby saving the manufacturing cost and time of the headlamp and reducing the size of the headlamp.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A lamp for a vehicle, the lamp comprising:

a lens being convex outwardly, the lens configured to transmit light;

a reflector disposed inward from the lens, being convex upwardly, and configured to reflect light;

a low-beam generator disposed below the reflector, the low-beam generator configured to emit a low beam; and a high-beam generator disposed below the low-beam generator, the high-beam generator configured to emit a high beam, wherein a portion of the low beam emitted from the low-beam generator is reflected by an area of the reflector close to the low-beam generator, and reaches a central area of the lens, wherein the high-beam generator comprises:

a high-beam light source configured to generate a high beam;

a rod for providing a path through which the high beam generated by the high-beam light source travels; and a high-beam emitter by which the high beam traveling through the rod is emitted to the lens.

2. The lamp of claim 1, wherein a portion of the low beam emitted from the low-beam generator is reflected by a peripheral area of the reflector being closest to the low-beam generator, and reaches the central area of the lens.

3. The lamp of claim 1, wherein the lens comprises:

an upper lens forming an upper area of the lens;

a lower lens forming a lower area of the lens; and a connection area disposed between the upper lens and the lower lens, a portion of the low beam emitted from the low-beam generator is reflected by the area of the reflector close to the low-beam generator, and reaches the connection area of the lens, and the connection area is disposed in the central area.

4. The lamp of claim 3, wherein a portion of the high beam emitted from the high-beam generator reaches the connection area of the lens, and the low beam and the high beam overlap in the connection area.

5. The lamp of claim 3, wherein a radius of curvature of the upper lens is different from that of the lower lens.

6. The lamp of claim 1, further comprising a shield disposed below the low-beam generator and above the high-beam generator, the shield configured to block at least a portion of the low beam emitted from the low-beam generator.

7. The lamp of claim 6, wherein the shield has a recessed portion in a peripheral area thereof, the recessed portion facing the lens.

8. The lamp of claim 1, wherein the high-beam light source comprises a plurality of high-beam light sources, the rod comprises a plurality of rods, and the plurality of high-beam light sources and the plurality of rods correspond to each other in one-to-one relationships.

9. The lamp of claim 8, wherein on/off operations of the plurality of high-beam light sources is controlled independently of each other.

10. The lamp of claim 1, wherein the central area of the lens, into which a portion of the low beam emitted from the low-beam generator is transmitted by being reflected by the area of the reflector close to the low-beam generator, has a vertical width of 5 mm to 7 mm.

11. A vehicle comprising a lamp, wherein the lamp comprises:

a lens being convex outward, the lens configured to transmit light;

a reflector disposed inward from the lens, being convex upwardly, and configured to reflect light;

a low-beam generator disposed below the reflector, the low-beam generator configured to emit a low beam; and a high-beam generator disposed below the low-beam generator, the high-beam generator configured to emit a high beam, wherein a portion of the low beam emitted from the low-beam generator is reflected by an area of the reflector close to the low-beam generator, and reaches a central area of the lens, wherein the high-beam generator comprises:

a high-beam light source configured to generate a high beam;

a rod for providing a path through which the high beam generated by the high-beam light source travels; and a high-beam emitter by which the high beam traveling through the rod is emitted to the lens.

12. The vehicle of claim 11, wherein the lamp is mounted to a front of the vehicle.

* * * * *